US008307875B2

(12) United States Patent
Griebel

(10) Patent No.: US 8,307,875 B2
(45) Date of Patent: Nov. 13, 2012

(54) SECTIONAL GATE WITH ESCAPE DOOR

(75) Inventor: Edgar Griebel, Wurzburg (DE)

(73) Assignee: Niewohner Industrie GmbH & Co., KG, Gutersloh (DE)

( * ) Notice: Subject to any disclaimer, the term of this patent is extended or adjusted under 35 U.S.C. 154(b) by 464 days.

(21) Appl. No.: 11/394,934

(22) Filed: Apr. 1, 2006

(65) Prior Publication Data

US 2006/0175026 A1 Aug. 10, 2006

(51) Int. Cl.
*E06B 3/48* (2006.01)

(52) U.S. Cl. ..... 160/116; 160/180

(58) Field of Classification Search ..... 160/116, 160/180, 133, 185, 186, 187, 201; 292/DIG. 36
See application file for complete search history.

(56) References Cited

U.S. PATENT DOCUMENTS

| | | | | | |
|---|---|---|---|---|---|
| 1,956,372 | A * | 4/1934 | Clark | ..... | 160/116 |
| 1,961,674 | A * | 6/1934 | Moss | ..... | 160/116 |
| 1,989,657 | A * | 1/1935 | McCloud | ..... | 160/116 |
| 1,989,658 | A * | 1/1935 | McCloud | ..... | 160/116 |
| 2,759,227 | A * | 8/1956 | Reid et. al. | ..... | 160/116 |
| 3,022,817 | A * | 2/1962 | Cafardi | ..... | 160/113 |
| 3,163,033 | A * | 12/1964 | Boyles | ..... | 70/100 |
| 3,991,595 | A * | 11/1976 | Bahry et al. | ..... | 70/120 |
| 4,603,723 | A * | 8/1986 | Sugihara | ..... | 160/35 |
| 4,745,708 | A * | 5/1988 | Roche | ..... | 49/395 |
| 5,577,541 | A * | 11/1996 | McKeon | ..... | 160/7 |
| 5,673,740 | A * | 10/1997 | Park | ..... | 160/116 |
| 6,006,814 | A * | 12/1999 | Dalpe | ..... | 160/116 |
| 6,227,278 | B1 * | 5/2001 | Forsland | ..... | 160/107 |
| 2003/0141023 | A1 * | 7/2003 | Griebel | ..... | 160/180 |

* cited by examiner

*Primary Examiner* — David Purol
(74) *Attorney, Agent, or Firm* — Edwin D. Schindler

(57) ABSTRACT

A sectional gate with an escape door includes a plurality of vertically displaceable gate sections, which are foldably connected to one another along their horizontally extending longitudinal edges. The escape door is inserted into the sectional gate and is constructed from door sections, which are foldably connected to one another. A device for opening and closing the escape door and a locking mechanism are non-positively engaged in at least one of the gate sections. The device for opening and closing the escape door are non-positively connected with one or more sliding bolts, which extend in vertical and horizontal directions to the locking mechanism, which engages in at least one of the gate sections. The sliding bolts that extend in the vertical direction are sub-divided into a plurality of sliding bolt sections and connected to one another in an articulated manner in the fold region of two door sections, and are non-positively connected at a bottom end to the sliding bolts that extend in the horizontal direction, with the movement of the sliding bolts or of the locking mechanism, or both, being able to be arrested.

17 Claims, 7 Drawing Sheets

SECTIONAL GATE WITH ESCAPE DOOR

BACKGROUND OF THE INVENTION

1. Technical Field of the Invention

The present invention relates to a sectional gate with escape door, comprising a plurality of vertically slidable gate sections, which are foldably connected to one another along their horizontally extending longitudinal edges, the escape door being inserted into the sectional gate and being constructed from gate sections, which are foldably connected to one another, and comprising a closing mechanism, which engages non-positively in at least one of the gate sections.

2. Description of the Prior Art

For sectional gates with built-in escape doors, it is generally true that, before the opening of the sectional gate, the escape door, or at least the lowermost door section thereof is connected to the adjacent gate sections by means of a connection that is detachable, but as stable as possible. This is necessary because the gate sections, which are only laterally guided by means of rollers, are interrupted by the escape door, and thereby destabilized.

In the prior art, German Patent Application No. 100 37 329 A1 discloses a sectional gate with escape door. For anchorage with the gate sections, closing bolts are provided in one of the lower door sections, the movement of which is triggered by lateral rollers in dependence on the position of the sectional gate. Disadvantageously, the connection between gate sections and the escape door cannot be released or produced by actuating the handle of the escape door.

SUMMARY OF THE INVENTION

Against this background, it is the object of the present invention to design an escape door for sectional doors, of which, when the handle is operated for opening the door, the closing mechanism releases from the anchorages in the gate sections and remains in the arrested position for as long as the escape door is open. When the escape door is closed, the arrestment should be automatically released and the closing mechanism in the lower region of the escape door should engage in the adjacent gate sections. The engagement of the elements forming part of the closing mechanism of the escape door should effect maximum stabilization of the sectional gate. The escape door should be installable during final installation of the gate, i.e., before transportation thereof onto the construction site, without further installation work having to be performed on site.

To achieve the object, the invention teaches a sectional gate with escape door, which is characterized in that the means for opening and closing the escape door are connected by means of one or more sliding bolts, which extend in a vertical and horizontal direction, to the closing mechanism, which engages in at least one of the gate sections, the sliding bolts that extend in a vertical direction being subdivided into a plurality of sliding bolt sections and being connected in an articulated manner to one another in the fold region, and being non-positively connected at their bottom end to the sliding bolts extending in the horizontal direction and the movement of the sliding bolts and/or of the clamping mechanism being arrestable.

The actuation of the handle moves the sliding bolts that extend in a vertical direction. By virtue of the non-positive connection between the sliding bolts extending in a vertical direction and the sliding bolts extending in a horizontal direction, actuation occurs of the closing mechanism, which is installed in each case in the end region of the horizontal sliding bolt.

The gist of the invention includes the fact that the sliding bolts that extend in a vertical direction within the door sections or parallel to the door sections, and which are arrestable, effect non-positive engagement of a closing mechanism, which comprises a closing bolt and/or of closing claws, in the adjacent gate sections, independently of the position of the handle or of the escape door. Here, the sliding bolts that extend in a vertical direction are provided with joints, the axes of the sliding bolt joints coinciding with the axes of the door sections, that is to say, extend coaxially thereto.

It is provided that the arresting device of the sliding bolts and of the closing mechanism can be activated or deactivated depending on the position of the handle and/or of the escape door.

In a preferred embodiment, the arresting device, comprising two elements that are connected to one another in an articulated manner, is movably connected to the door frame or to the case of the escape door and can also be movably fixed to the free end of the second element at one of the sliding bolt sections that are movable in a vertical direction. With the actuation of the handle on the escape door, the sliding bolt sections that are movable in a vertical direction are moved upwards, the elements of the closing mechanisms being removed from the adjacent gate sections and releasing the escape door to open. The arrestment of the vertical sliding bolt sections by the above-described arrestment device takes place at the latest with the opening of the escape door. The blocking of the sliding bolts also automatically blocks the elements of the closing mechanism.

In a particularly preferred embodiment of the escape door, the arrestment device has a rotatable roller, by means of the guide of which, a bending or extension of the elements that form part of the arrestment takes place in dependence on the displacement of the sliding bolts, which are movable in the vertical direction. In the above-described case, the bending of the arrestment device under the influence of the roller releases the movement of the sliding bolt and of the elements of the closing mechanism for engagement in the gate sections.

Alternatively, the release of the sliding bolts can also take place via the actuation of closing contacts or door latches, which are provided in the region of the frame of the escape door and the arrestment device can be deactivated by the activation thereof. On deactivation of the arrestment, the elements forming part of the closing mechanism are inserted into the adjacent gate sections.

After operation of the handle for opening the escape door, and while the escape door is open, the closing bolts or closing claws belonging to the closing mechanism are held in the driven-in position by an arrestment device that blocks the drive of the closing mechanism. With the closing of the door and/or the movement of the handle back into the starting position, the arrestment is released, so that the elements of the closing mechanism can engage in the gate sections again, either manually or under the influence of a drive, which may include, for example, of a pneumatic spring.

It is within the scope of the invention that the movement of the non-positively interconnected sliding bolts can be driven in various ways familiar to a person skilled in the art. It is provided that the drive can be activated or deactivated by means of the door handle, acting as switch, or of a separate arrestment device, which is connected to the door handle.

The joints in the sliding bolts extending in a vertical direction are positioned and shaped such that the movement of the individual gate sections in the runners is not affected during opening of the gate. The axes of the sectional-gate sections, which are foldably connected to one another, are coaxial to the axes of the escape-door sections, which are also foldably connected to one another. By means of this arrangement or at least of the parallel arrangement of the axes with respect to one another, it is achieved that the resistance of the gate sections is minimum when the latter move through the curvature region of the runners.

To improve the mobility of the vertical sliding bolts, it is provided that, in the region of the bending axes, the vertical sliding bolts are angled in the direction of the gate inside. The angled sections respectively overlap one another and have openings that serve for the passage of an axis. By means of the angled shape, it is ensured that the sliding bolts are not curved when the sections are in the curvature region of the runners.

To receive the sliding bolt sections, which are connected by means of joints, the door sections, in the regions in which two respective door sections meet, have recesses. The recesses are dimensioned in the vertical direction such that they correspond to at least the sliding-bolt stroke. The sliding bolt stroke is of course independent of the type of closing mechanism, it being provided that an inclination of the door handle through 40° leads to a sliding bolt stroke of approx. 20 mm. However, the stroke transmitted to the horizontally oriented sliding bolt can be increased or reduced by means of an appropriate translation.

The door sections can be enclosed by a door case inserted into the sectional gate. It is provided that the sections of the escape door extend over at least two gate sections. The escape door is provided with a handle set, the handle of which is non-positively connected to the sliding bolt that extends in a vertical direction.

The sliding bolts that extend in a vertical direction are non-positively connected to the sliding bolts extending in the horizontal direction by means of toothed wheels or toothed wheel sections. Alternatively, the non-positive connection may take place by means of rods, which are connected in each case at their ends to one of the sliding bolts and to a rotatably mounted lever arm.

For diverting the force proceeding from the sliding bolts extending in a horizontal direction into a force that is directed in a horizontal direction in both directions, a drive-direction converter is provided. This drive-direction converter comprises essentially of two drive bolts that are provided, on their end sections, with teeth that lie parallel to one another on a toothed wheel. The movement of one sliding bolt inevitably leads, by virtue of the rotation of the toothed wheel, to movement of the second sliding bolt in the opposite direction. By the use of a drive direction converter of the above-described design, it is possible, by means of a vertically aligned sliding bolt, to actuate a closing mechanism that acts in a horizontal direction at both sides.

In a further development of the invention, it is provided that the closing mechanism includes one or more fastening claws or closing bolts. The use of fastening claws has the advantage that, by virtue of their profile, which bears against a bolt that forms part of the sectional gate, an additionally stabilizing tension or pressure can be generated. The additional stabilization of the sectional gate is important because the individual gate sections are interrupted by the installation of an escape door, and thereby destabilized.

The fastening claws may be comprised of circular sections of a toothed wheel, the narrow sides of the toothed wheel sections having depressions, which engage around the anchor bolts forming part of the sectional gate.

The curved portion of the circular sections is provided with teeth, which engage in a suitably fitting profile of a sliding bolt. Because of this non-positive connection, the movement of the sliding bolt also leads to engagement of the fastening claw in the anchor bolts intended for this purpose.

The non-positive connection between the vertically extending sliding bolts and the horizontally extending sliding bolts, or the horizontally extending closing bolts as appropriate, can be made by means of lever arms. Here, one arm of the rotatably mounted lever arm is connected by means of a rod to the vertically extending sliding bolt. The second arm of the lever is rotatably connected in the same manner, that is to say at its end to the sliding bolt or closing bolt extending in the vertical direction. It is conceivable that the second arm of the lever serves as a fastening claw. In this case, the lever arm has a recess, which after a corresponding movement transmitted via the sliding bolts and rods engages around the anchor bolts located in the gate sections.

It lies within the scope of the invention that the closing mechanism has two fastening claws; one of the fastening claws moving upwards and the other moving downward. After engaging around the anchor bolts, with a corresponding profiling of the fastening claws, a tension and/or pressure force occurs, which leads to an additional stabilization of the escape door within the sectional gate. It is also conceivable for the respective lower fastening claw to operate on tension and the respective upper claw on pressure. Of course, an opposing build up of the forces is conceivable.

In a particularly preferred embodiment of the invention, six fastening claws are disposed in each case on both sides of the lowermost door sections, which are installed in a hexagonal profile, which is connected to the lowermost door section, in the corners of the profile in each case, and, when the door is closed, engage in the openings of the adjacent gate sections.

BRIEF DESCRIPTION OF THE DRAWING FIGURES

Further details and features of the invention are explained below in greater detail with reference to examples. The illustrated examples are not intended to restrict the invention, but only to explain it. In schematic view.

DETAILED DESCRIPTION OF THE DRAWING FIGURES AND PREFERRED EMBODIMENTS

Figure 1:
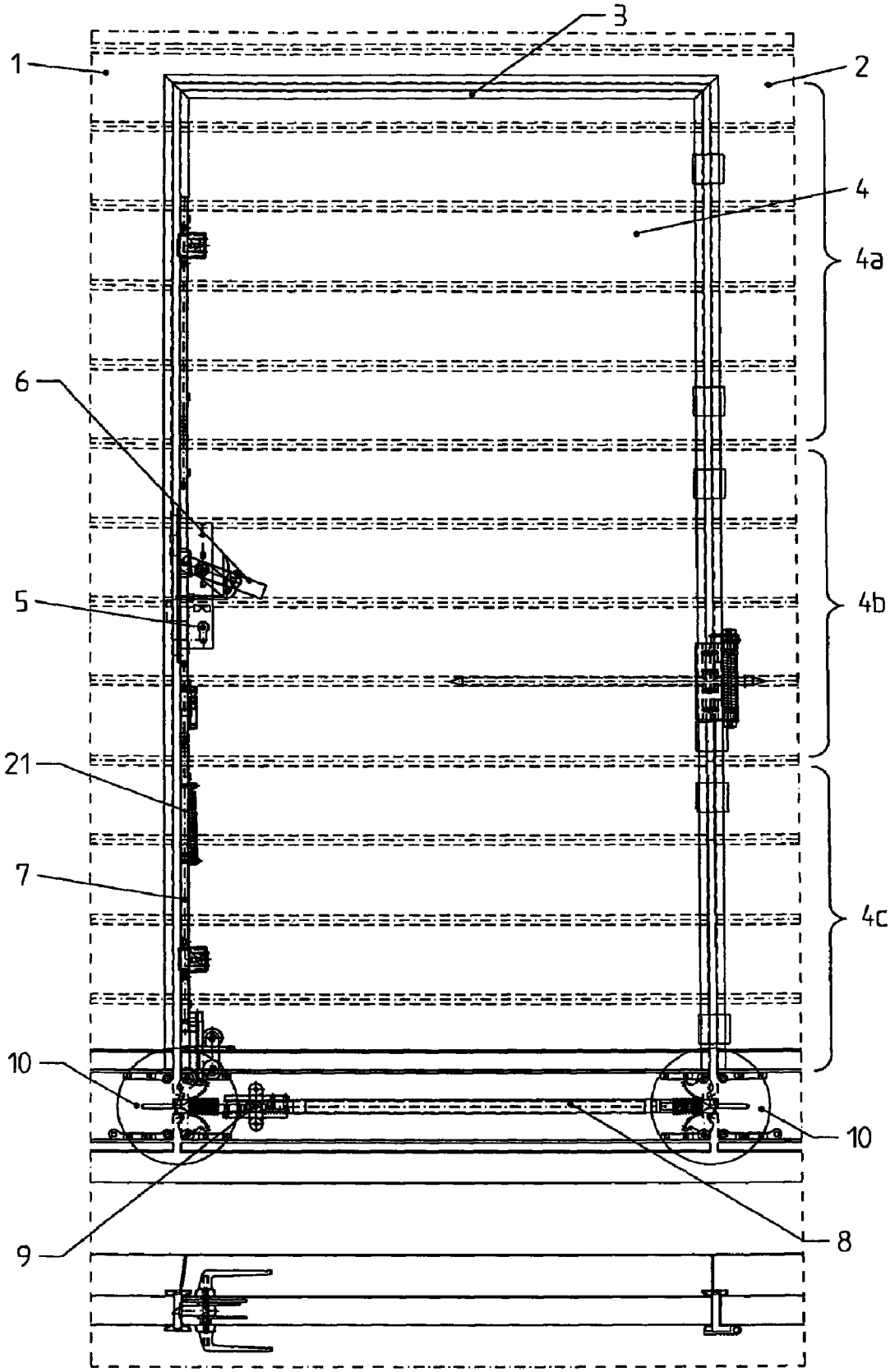
FIG. 1 shows an escape door inserted into a sectional door.

FIG. 1 shows the top view of an escape door 3, which is inserted into the sections 2 of the sectional door 1. The escape door 3 is comprised of sections 4 that, like the gate sections, are foldably connected to one another, so that the gate or the door can be moved through the curvature region of the runners. The escape door 3 has a door lock 5, which can be actuated by means of a handle 6. Starting from handle 6 of the door lock, the vertical sliding bolts or portions 7 thereof guide downwards, mediated by toothed wheels or toothed wheel sections, the movement of the vertically oriented sliding bolts or sliding bolt sections 7 is transmitted up into sliding bolts or sliding bolt sections 8, which are oriented in a horizontal direction. With the aid of the sliding bolt converter 9, it is possible to transmit the movement proceeding from the vertically oriented sliding bolt horizontally in both directions. To support the movement of the sliding bolts, the escape door 1 has a pneumatic spring 21 in the region of the vertically extending sliding bolts 7. The pneumatic spring 21 is actuated as a drive by means of a switch, which is connected to the door handle 6.

Figure 2:
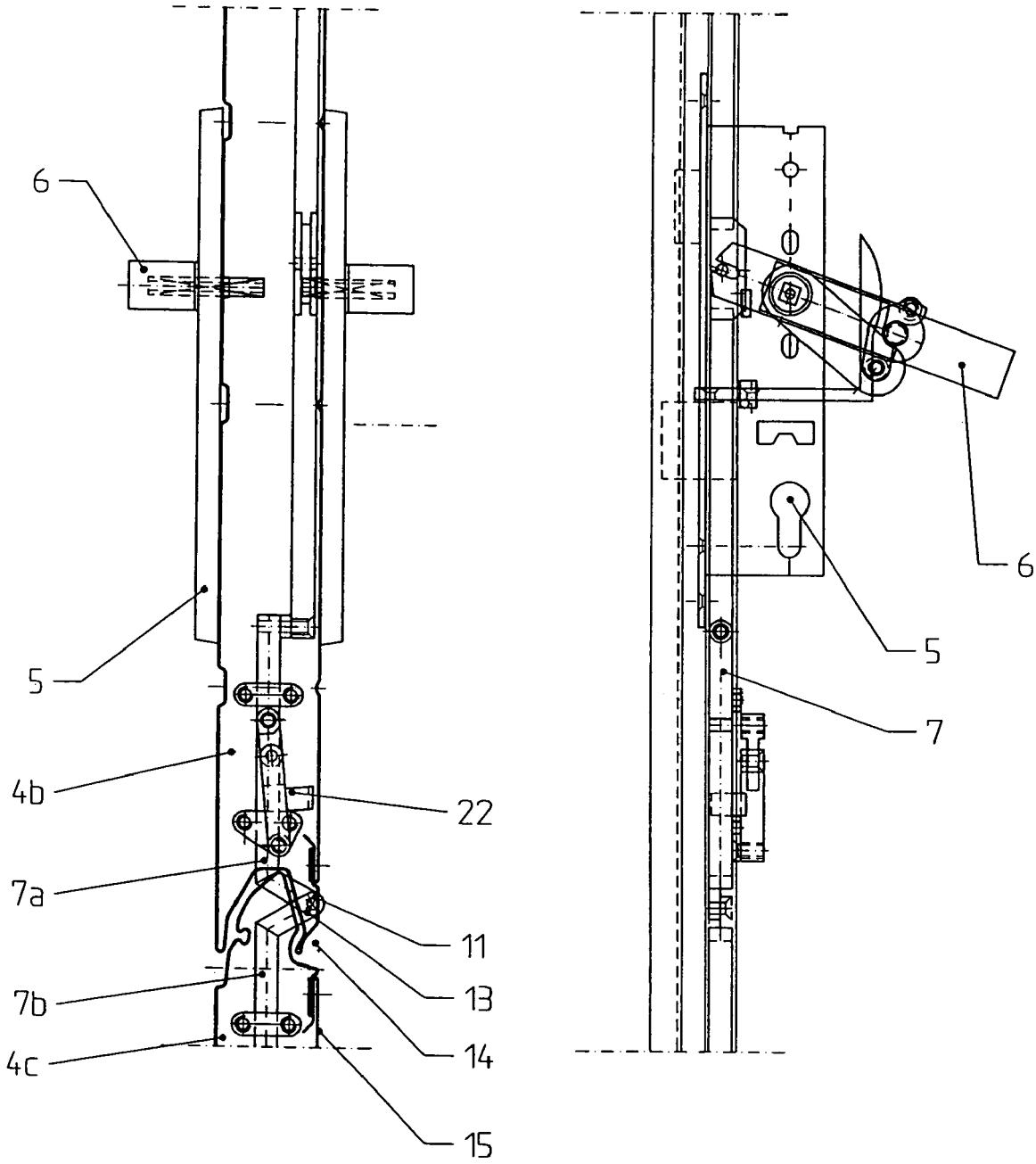
FIG. 2 shows a door lock of the escape door with vertically extending sliding bolts.

FIG. 2 shows a portion of the escape door 3 in the region of the door lock 5 in a two-sided view. It shows that sliding bolt section 7*a* that extends in a vertical direction, which is movably connected by means of a joint 13 to the sliding bolt section 7*b*. The sliding bolt sections 7*a* and 7*b* are angled at their ends, the joint 13 being located at the ends sections that are angled at the end thereof. In this manner, it is ensured that the sliding bar sections 7*a* and 7*b*, in the curvature region of the runners, can be curved together with the door sections 4*a* and 4*b*, which are also movably connected, without a lever action. FIG. 2 furthermore shows a recess 14 that is dimensioned such that it is adapted to the correspondingly required sliding bolt lift. The locking device 22 prevents the locking mechanism from being activated when the door is open.

Figure 3:
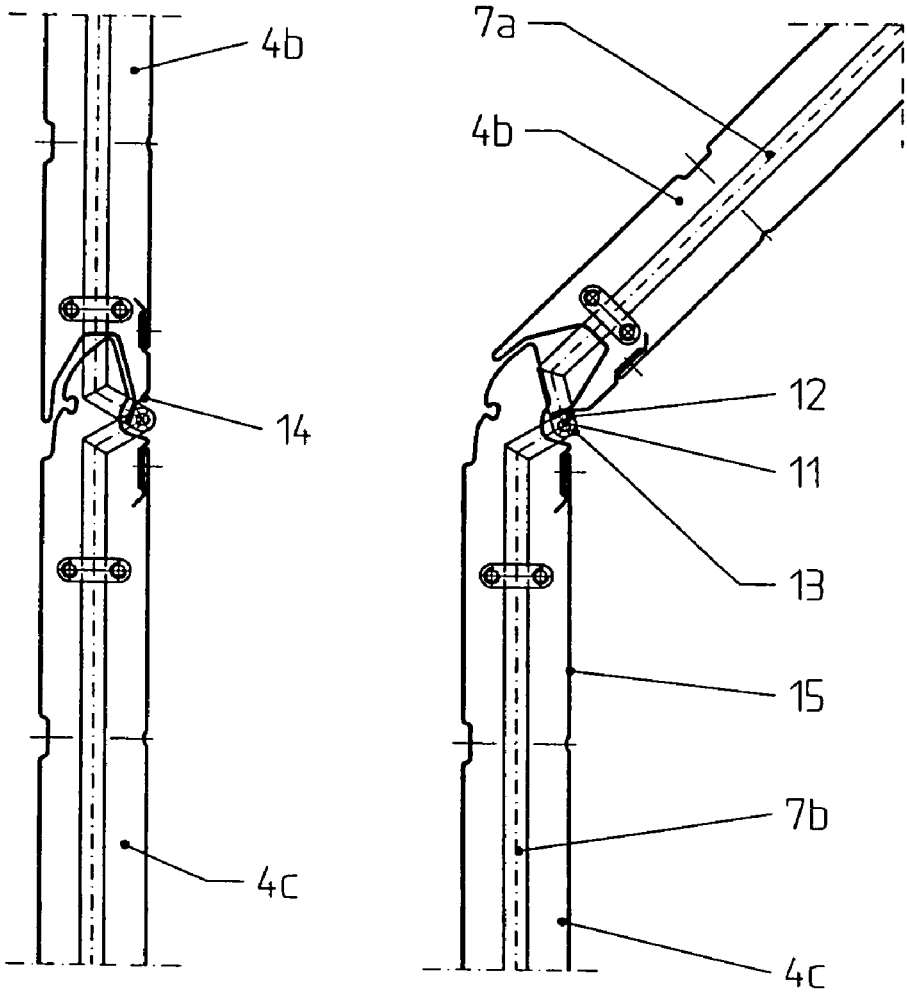
FIG. 3 shows cross-sections of two door sections with vertically extending sliding bolt sections that are connected by means of an angled joint.

FIG. 3 shows a cross-section through two sliding bolt sections 7*a* and 7*b*, which extend in the vertical direction and are movably connected to one another via the joint 13. The sliding bolt sections 7*a* and 7*b* are inset into the door sections 4*a* and 4*b* in the illustrated example.

Figure 4:
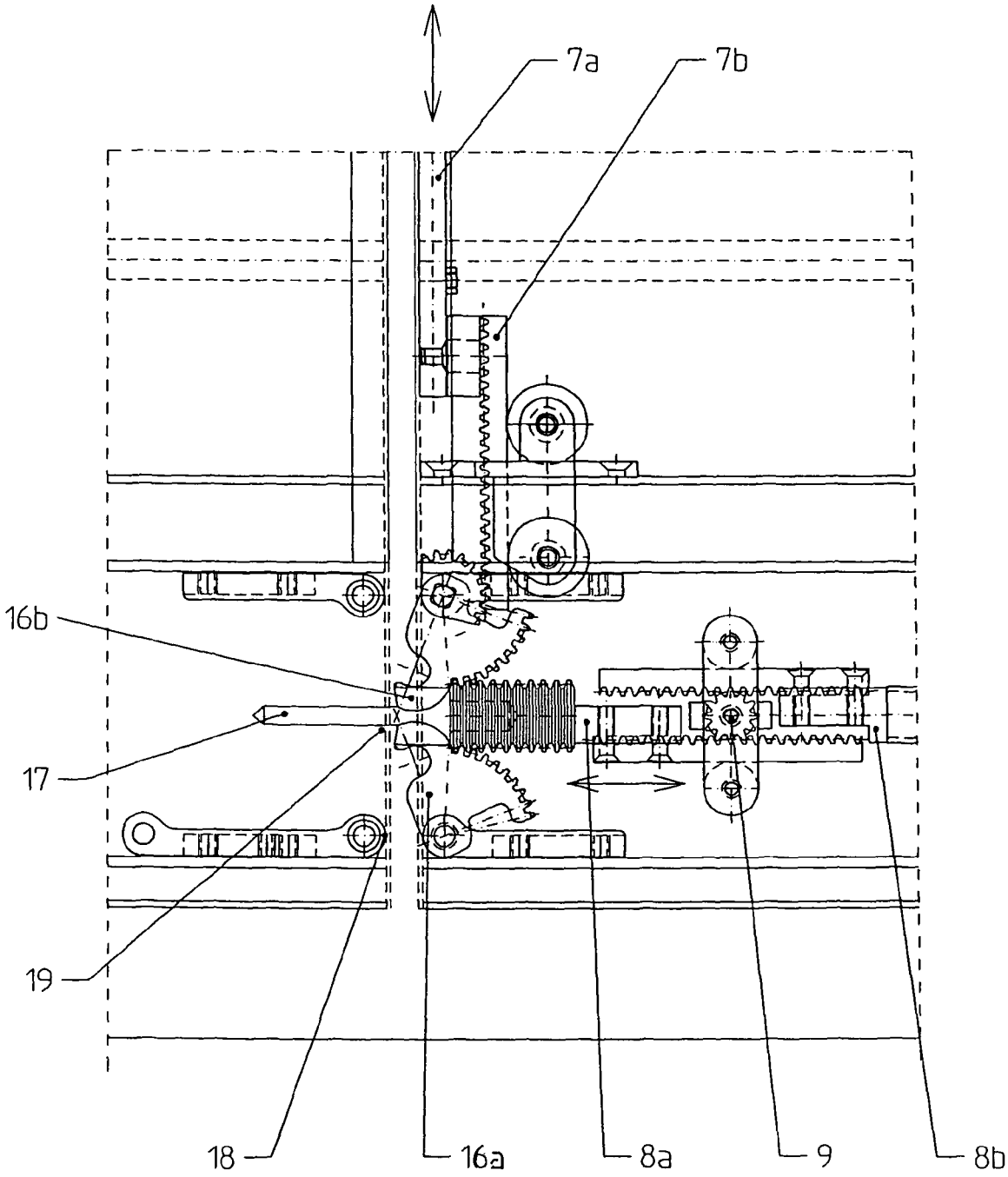
FIG. 4 shows the closing mechanism of the escape door.

FIG. 4 shows in cross-section one of the variety of possibilities for force transmission of the movement from the vertical sliding bolts 7*a* and 7*b* respectively to the horizontally extending runners 8*a* and 8*b* or to the closing bolt 17. The toothed profile of the sliding bolt 7*b* lies on a toothed wheel, which is connected to a fastening claw, which in turn, with its outer curve, drives a fastening bolt 17 in the manner of a gear. The fastening claw 16*a* and 16*b* engages around the anchor bolt 18 which forms part of the sectional gate. By virtue of the upwardly and downwardly directed movement of the fastening claws 16*a* and 16*b*, tension and pressure forces are generated, leading to an additional stabilization of the escape door within the interrupted gate sections. For transmitting the movement of the sliding bolt 7*a* and 7*b*, which is oriented in a vertical direction, to the opposition side of the escape door—which is not shown—the drive-direction converter 9 is provided. The drive-direction converter 9 consists of a toothed wheel, of which the teeth engage in the sliding bolt 8*a* and, at the same time non-positively interact at the opposite side with the sliding bolt 8*b*. By virtue of the rotation of the drive-direction converter 9, with parallel orientation of the sliding bolt 8*a* and 9*b*, there is inevitably a movement of the drive-direction in the respective opposite direction.

Figure 5:
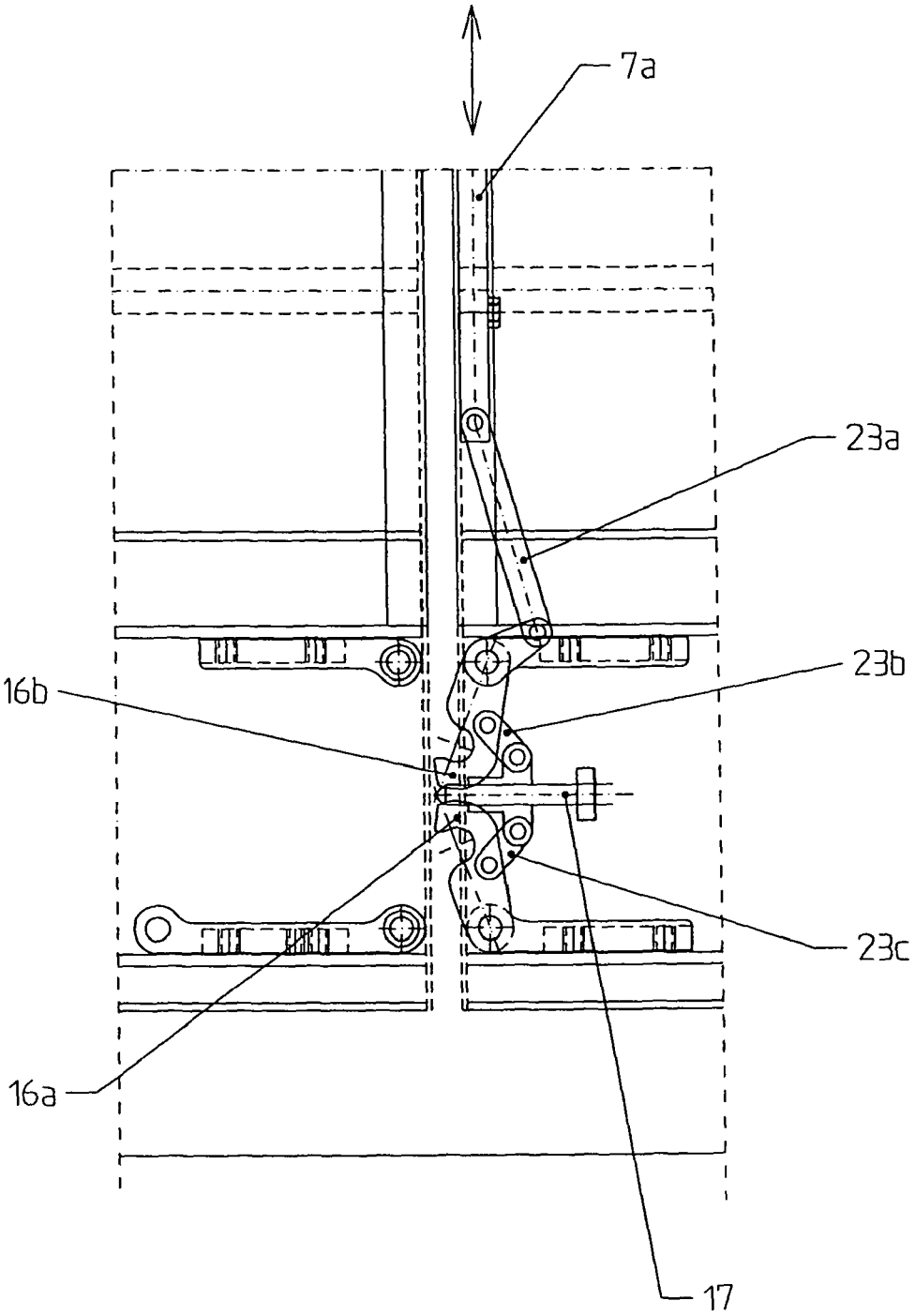
FIG. 5 shows the closing mechanism of the escape door with force transmission via a lever.

FIG. 5 shows the force transmission from the sliding bolt 7*a*, which extends in a vertical direction, to the closing bolt 17, which extends in a horizontal direction, via the fastening claw 16*b*, which is arranged in the manner of a lever. A lever arm of the fastening claw 16*b*, which is constructed in the manner of a lever, is non-positively connected to the sliding bolt 7*a* by means of a rod 23*a*, which is mounted at its ends in each case so as to be rotatable. The second lever arm of the fastening claw 16*b* is connected to the closing bolt 17 by means of the rod 23*b*. In the illustrated example, the closing bolt 17 is in turn non-positively connected by means of a further rod 23*c*, which is mounted at its ends, in each case, so as to be rotatable, to a further fastening claw 16*a*.

Figure 6:
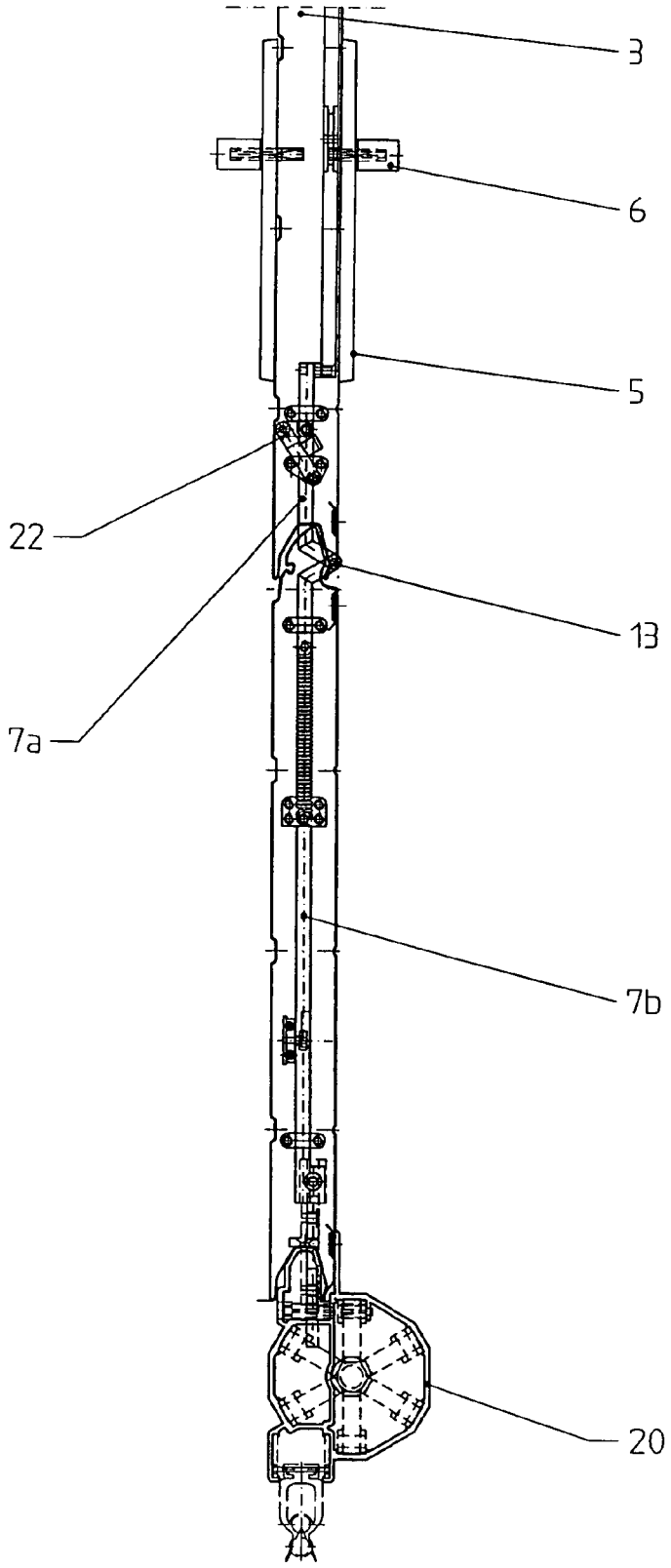
FIG. 6 shows a cross-section through the escape door with a vertically extending sliding bolt and closing mechanism with six fastening claws in each case; and, FIG. 7 shows a two-side view of the arresting device.

FIG. 6 shows the sliding bolts 7*a* and 7*b*, which extend in a vertical direction within the escape door 3 and are movably connected to one another via a joint 13. The arresting device 22 prevents the locking mechanism 20 from being activated when the escape door 3 is open. When the door is locked, the arresting device 22, which in this case is constructed in two parts, is angled over and, in this position, leads to activation of the closing mechanism 20. The sliding bolts 7*a* and 7*b* operate the fastening device 20, which in this case is provided in the lowermost gate section. The fastening device 20 is characterized in that six closure claws in each case are arranged in the corners of a hexagonal profile. The fastening claws engage in the openings of the respective adjacent gate section in order to produce a particularly non-positive connection.

Figure 7:
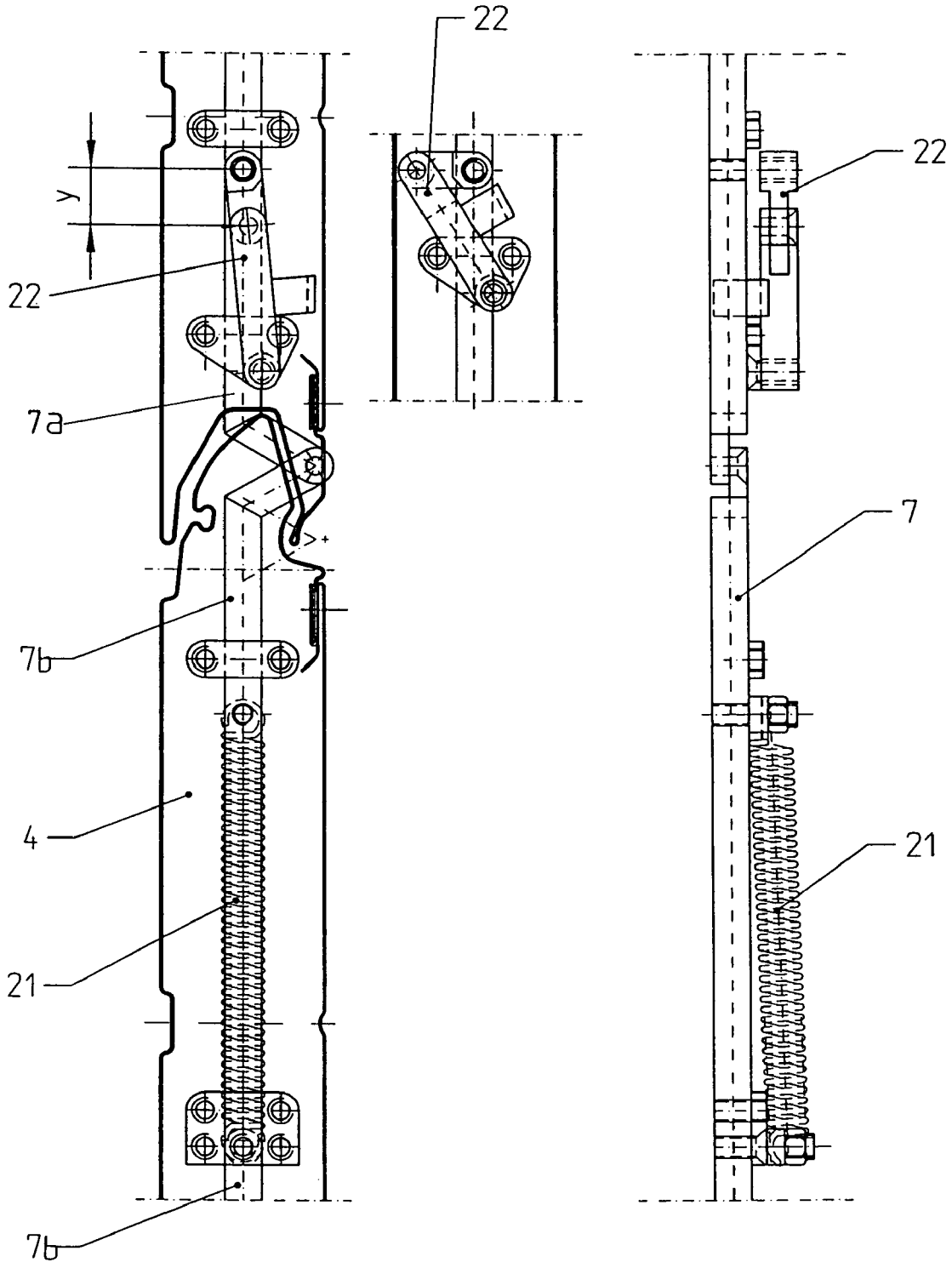

FIG. 7 shows a two-side view of the arresting device 22, which consists of two elements, which are connected to one another in an articulated manner and are connected at one free end to a vertically movable sliding bolt and at the other end to the door case or the frame of the escape door. The connection of the arresting device 22 to the sliding bolt 7 and to the frame of the escape door 3 is in each case movable. The arresting device 22 is shown in angled form, that is to say with the escape door 3 closed. After actuation of the handle 6 of the escape door 3, the vertically movable sliding bolt 7 is moved upwards by the distance y, which corresponds to the sliding bolt stroke, and then, in extended form, arrests the sliding bolt 7. By virtue of the arrestment, the drive 21 is blocked and prevented from moving the sliding bolt 7 downwards and thereby actuating those elements of the closing mechanism 10 that are connected to the sliding bolt 8 that extends in a horizontal direction.

LIST OF REFERENCE CHARACTERS

1. Sectional gate
2. Gate sections
3. Escape door
4. Door sections
5. Door lock
6. Handle
7. Vertically extending sliding bolt/sliding bolt sections
8. Horizontally extending sliding bolt/sliding bolt sections
9. Drive-direction converter
10. Closing mechanism
11. Axis connecting vertically extending sliding bolt sections
12. Angled end of vertically extending sliding bolt sections with opening
13. Articulated connection between vertically extending sliding bolt sections
14. Recess between the door sections on the gate inside to receive the joint between two vertically extending sliding bolt sections
15. Gate inside
16. Fastening claw
17. Closing bolt
18. Recesses and openings in the sectional gate to receive the fastening claws and anchor bolts
19. Opening in the sectional gate for the closing bolt
20. Closing mechanism with six fastening claws in each case
21. Pneumatic spring for actuating the sliding bolts
22. Arresting device of the closing mechanism
23. Rods for force transmission

What is claimed is:

1. A sectional gate with an escape door, comprising:

a plurality of vertically displaceable gate sections foldably connected to one another along horizontally extending longitudinal edges of said vertically displaceable gate sections;

an escape door located within an area of said sectional gate and constructed from door sections foldably connected to one another; and, means for opening and locking said escape door having an arresting device, a handle and a lock with a locking mechanism non-positively engagable in at least one vertically displaceable gate sections of said plurality of vertically displaceable gate sections, said lock and said handle for said escape door being non-positively connected with a sliding bolt extending in a vertical direction and a sliding bolt extending in a horizontal direction to said locking mechanism, said sliding bolt extending in the vertical direction being non-positively connected at a bottom end to said sliding bolt extending in the horizontal direction with movement of at least one of said sliding bolts extending in the vertical direction and said locking mechanism being arrestable via said arresting device, said arresting device including a first element and a second element connected to one another with a free end of said first element'being movably connected to said escape door and a free end of said second element being movably connected to said sliding bolt extending in the vertical direction with said arresting device being capable of causing movement via said handle of said sliding bolt extending in the vertical direction for preventing said locking mechanism from being activated when said escape door is open.

2. The sectional gate with an escape door according to claim 1, wherein said first element or said second element of said arresting device includes a rotatable roller, said rotatable roller being dependent upon displacement of said at least one sliding bolt in said vertical direction for initiating an extension of said arresting device.

3. The sectional gate with an escape door according to claim 1, further comprising drive means for moving said at least one sliding bolt extending in said vertical direction, said drive means including an electromagnetic drive, a hydraulic drive or a pneumatic drive.

4. The sectional gate with an escape door according to claim 1, wherein said at least one sliding bolt extending in said vertical direction extends coaxially to an axis between, at least one of, said vertically displaceable gate sections and said door sections.

5. The sectional gate with an escape door according to claim 1, wherein said escape door comprises gate sections and a door leaf constructed from a plurality of said door sections.

6. The sectional gate with an escape door according to claim 1, wherein said door sections vertically pass over, at least, two of said vertically displaceable gate sections.

7. The sectional gate with an escape door according to claim 1, wherein the connection between said at least one sliding bolt in said vertical direction and said at least one sliding bolt in said horizontal direction is effected via a toothed wheel.

8. The sectional gate with an escape door according to claim 7, wherein at least two sliding bolts extending in said horizontal direction have toothed profiles on said toothed wheel.

9. The sectional gate with an escape door according to claim 1, wherein the connection between said at least one sliding bolt in said vertical direction and said at least one sliding bolt in said horizontal direction includes a lever arm.

10. The sectional gate with an escape door according to claim 1, wherein said lock comprises at least one fastening claw connected to said at least one sliding bolt extending in said horizontal direction, said at least one fastening claw being engagable in recesses forming a part of said sectional gate.

11. The sectional gate with an escape door according to claim 10, wherein said recesses in said sectional gate have anchors for receiving said at least one fastening claw are connected to said at least one sliding bolt in said horizontal direction.

12. The sectional gate with an escape door according to claim 10, wherein said at least one fastening claw engages in said recesses in said sectional gate and encloses at least a portion of said anchors positioned therein.

13. The sectional gate with an escape door according to claim 10, wherein said at least one fastening claw includes an upper fastening claw and a lower fastening claw, each of said upper fastening claw and said lower fastening claw operating under tension.

14. The sectional gate with an escape door according to claim 1, wherein said lock includes six fastening claws engageable in said sectional gate when said escape door is closed.

15. The sectional gate with an escape door according to claim 1, wherein said vertically displaceable gate sections have recesses for receiving closing bolts.

16. The sectional gate with an escape door according to claim 1, further comprising gear wheel sections for connecting between said at least one sliding bolt extending in said vertical direction and said at least one sliding bolt extending in said horizontal direction.

17. The sectional gate with an escape door according to claim 1, further comprising a rotatably mounted lever arm for connecting between said at least one sliding bolt extending in said vertical direction and said at least one sliding bolt extending in said horizontal direction, said rotatably mounted lever arm being connected on each end of said at least one sliding bolt extending in said vertical direction and to said at least one sliding bolt extending in said horizontal direction.

* * * * *